US006619771B2

(12) United States Patent
Kueng et al.

(10) Patent No.: US 6,619,771 B2
(45) Date of Patent: Sep. 16, 2003

(54) SELF-POSITIONING CABINET RAIL FOR A DRAWER GUIDE

(75) Inventors: Wernfried Kueng, Kernersville, NC (US); Joseph B. Larsen, Jr., Belews Creek, NC (US); Kerry L. Kerr, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 10/010,861

(22) Filed: Dec. 6, 2001

(65) Prior Publication Data

US 2003/0107308 A1 Jun. 12, 2003

(51) Int. Cl.[7] ..... A47B 88/00

(52) U.S. Cl. ..... 312/334.1; 312/330.1; 312/334.4

(58) Field of Search ..... 312/330.1, 334.1, 312/334.7, 334.12, 334.14, 350

(56) References Cited

U.S. PATENT DOCUMENTS

| | | | | |
|---|---|---|---|---|
| 2,711,358 A | * | 6/1955 | Gussack | 312/333 |
| 3,351,406 A | | 11/1967 | Ropiequet et al. | |
| 4,141,525 A | | 2/1979 | Miller | |
| 4,176,890 A | | 12/1979 | Gorton | |
| 4,692,035 A | | 9/1987 | Rock et al. | |
| 5,203,620 A | | 4/1993 | McLennan | |
| 5,281,021 A | | 1/1994 | Rock et al. | |
| 5,292,192 A | | 3/1994 | Lautenschlager | |
| 5,303,997 A | | 4/1994 | Kropf | |
| 5,387,033 A | | 2/1995 | Domenig | |
| 5,433,517 A | | 7/1995 | Fleisch | |
| 5,439,283 A | | 8/1995 | Schroder et al. | |
| 5,449,231 A | | 9/1995 | Lin | |
| 5,470,144 A | | 11/1995 | Wen | |
| 5,490,724 A | | 2/1996 | Domenig | |
| 5,556,182 A | | 9/1996 | Lai | |
| 5,564,807 A | | 10/1996 | Rock et al. | |
| 5,692,816 A | * | 12/1997 | Lai | 312/334.4 |
| 5,722,749 A | | 3/1998 | Domenig | |
| 5,785,400 A | | 7/1998 | Grieser et al. | |
| 5,876,103 A | | 3/1999 | Domenig | |

FOREIGN PATENT DOCUMENTS

| | | | | |
|---|---|---|---|---|
| EP | 577885 A1 | * | 1/1994 | A47B/88/04 |
| JP | 04348709 A | * | 12/1992 | A47B/88/14 |

* cited by examiner

*Primary Examiner*—Lanna Mai
*Assistant Examiner*—John Fitzgerald
(74) *Attorney, Agent, or Firm*—John M. Harrington; Kilpatrick Stockton LLP

(57) ABSTRACT

A cabinet rail assembly includes a pair of cabinet rails, each of which is provided with a projection on the bottom edge of a front end portion that extends a predetermined distance below the bottom edge of the front end portion which is adapted to space the bottom edge of the cabinet rail by a pre-determined distance above a bottom member of the drawer opening. The projection on the front end of a left-hand cabinet rail is formed from a corresponding notch on the front end of a right-hand cabinet rail and vice versa. The projection on one of the cabinet rails is spaced a further distance from the front edge of the cabinet rail than the projection on the other of the cabinet rails; the projection on the front end portion of each of the cabinet rails corresponds to the notch in the front end portion of the other of the cabinet rails; and the projection on the front end portion of each of the cabinet rails is positioned adjacent the notch, which together with the projection, defines a generally S-shaped perimeter.

9 Claims, 3 Drawing Sheets

SELF-POSITIONING CABINET RAIL FOR A DRAWER GUIDE

FIELD OF THE INVENTION

The present invention relates generally to the field of drawer guides, and more particularly to a self-positioning cabinet rail for a drawer guide.

BACKGROUND OF THE INVENTION

Various types of pull-out drawer guides have been used in furniture such as cabinets, desks and the like for supporting drawers and similar moveable structures for many years. One such type of drawer guide has cabinet rails mountable to a furniture article and pull-out rails carrying the moveable structure, both of which are provided with rollers. The pull-out rail may support a drawer, a bin, a board or the like, and the respective rollers enable the pull-out guide and carried structure to be moved freely and without resistance between a forward, open position and a rearward, closed position.

Typically, this type of drawer guide includes a U-shaped cabinet rail and a Z-shaped pull-out rail. The U-shaped cabinet rail is mountable to a furniture article, such as a cabinet and serves as a track on which the Z-shaped pull-out rail and supported drawer rolls in and out of the drawer opening. The cabinet rail is made by first stamping out an elongate rectangular blank from a web of sheet metal and thereafter shaping by bending the long edges to form the upper and lower legs of the U-shaped cross section. Thus, the width of the blank is determined by the required dimensions of the U-shaped cross-section, which limits the width of the front end of the cabinet rail.

One disadvantage of this type of drawer guide is that when the pull-out rail is placed on the "track", the bottom leg of the Z-shaped pull-out rail typically extends below the lower member of the drawer opening. The result is that the bottom leg of the pull-out rail and the supported drawer do not clear the lower member of the drawer opening. Thus, it is necessary that the cabinet rail be spaced and mounted a pre-determined distance above the lower member of the drawer opening to enable the pull-out rail and supported drawer to clear it.

An approach to positioning the cabinet rail a pre-determined space above the bottom of the drawer opening is to provide a workman with a specially designed jig for pre-drilling holes for screws or the like for mounting the cabinet rail at the correct pre-determined distance. Alternatively, a workman can use a separate spacer which is placed between the cabinet rail and lower member of the drawer opening while mounting the cabinet rail to the cabinet to ensure that the proper spacing is attained. However, either solution is costly and time consuming.

Another solution is to make the entire front end of the cabinet rail wider by a distance equal to the required space so that aligning the bottom of the front end of the cabinet rail with the lower member of the drawer opening provides the required spacing. Although conceivably the blank of sheet metal could be stamped out in irregular shape with a wider end or perhaps trimmed that way, this approach requires altering the current specifications for making the cabinet rails, and the cost in wasted sheet metal alone is enormous.

An additional approach made known in U.S. Pat. No. 5,722,749, incorporated herein by this reference, is for the cabinet rail to include a downwardly bent projection for spacing the cabinet rail from the bottom of the drawer opening, which requires costly and time consuming additional steps in making the rail. In still another approach made known in U.S. Pat. No. 5,876,103, incorporated herein by this reference, the projection is not bent, but rather the projection extends parallel to the cabinet rail and has an extension member of resilient or semiresilient material disposed on the projection to space the cabinet rail from the bottom of the drawer opening. This approach not only increases the time and expense of making the rail, but also involves mounting an additional component.

SUMMARY OF THE INVENTION

It is a feature and advantage of the present invention to provide a self-positioning cabinet rail for a drawer guide that is relatively inexpensive to produce and easy to mount at a predetermined position within a cabinet.

It is another feature and advantage of the present invention to provide a self-positioning cabinet rail for a drawer guide of the type having a U-shaped cabinet rail and Z-shaped pull-out rail, which includes an inexpensive, readily accessible means for positioning the cabinet rail above the bottom of the drawer opening such that a supported drawer easily moves in and out of the drawer opening.

To achieve the stated and other features, advantages and objects, an embodiment of the present invention provides a cabinet rail assembly for supporting a drawer in a drawer opening of a furniture article including a pair of cabinet rails adapted to be mounted within opposite sides of the drawer opening. Each cabinet rail has a generally U-shaped cross section with a web portion disposed between upper and lower ledges, a front end portion with front and bottom edges, and a rotatable cabinet rail roller mounted on the front end portion. Each pair of cabinet rails includes a left-hand side cabinet rail and a right-hand side cabinet rail, each adapted to receive a corresponding drawer pull-out rail having a generally Z-shaped cross section. The cabinet rails are each provided with a projection on the bottom edge of the front end portion that extends a predetermined distance below the bottom edge of the front end portion which is adapted to space the bottom edge of the cabinet rail by the pre-determined distance above a bottom member of the drawer opening.

In an embodiment of the present invention, the cabinet rails are made by first stamping out a blank from a web of sheet metal and shaping the blank to form the U-shaped cross section of each cabinet rail. In order to conserve steel, the elongate blanks are stamped out in pairs for a left-hand cabinet rail and a right hand cabinet rail, with a generally S-shaped cut defining the projections. Thus, the projection on the front end of a left-hand cabinet rail is formed from a corresponding notch on the front end of a right-hand cabinet rail and vice versa. Therefore, the projection on one of the cabinet rails is spaced a further distance from the front edge of the cabinet rail than the projection on the other of the cabinet rails. In addition, the projection on the front end portion of each of the cabinet rails corresponds to the notch in the front end portion of the other of the cabinet rails. Further, the projection on the front end portion of each of the cabinet rails is positioned adjacent the notch, which together with the projection, defines a generally S-shaped perimeter of the projection and adjacent notch.

Additional novel features, advantages and objects of the invention will be set forth in part in the description which follows, and in part will become more apparent to those skilled in the art upon examination of the following, or may be learned by practice of the invention.

DETAILED DESCRIPTION

Referring now in detail to an embodiment of the present invention, an example of which is illustrated in the accompanying drawings, in which like numerals designate like components, the present invention provides a self-positioning cabinet rail for a drawer guide of a type used to support a moveable structure, such as a drawer, a bin, a board or the like, in a furniture article, such as a cabinet. Typically, a cabinet includes a drawer opening defined by side walls and upper and lower members. The drawer guide can be attached directly to a side wall, or if the cabinet has a face frame, the drawer guide can be fastened to a side member of the frame. The drawer guide includes a cabinet rail with a generally U-shaped cross section that has a roller mounted on its front end, and a pull-out rail with a generally Z-shaped cross section and a roller mounted on its rear end. It is to be noted that such drawer guides are made and sold in sets, each of which includes a left-hand side cabinet and pull-out rail and a right-hand side cabinet and pull-out rail. In use, the left-hand and right-hand side cabinet rails of a drawer guide set are mounted in the cabinet with their respective front ends positioned at or near the lower member of the drawer opening.

The lower legs of the Z-shaped pull-out rails of the drawer guide set are fastened to opposite bottom sides of a drawer, and the upper leg of each Z-shaped pull-out rail is rollingly supported by one of the cabinet rail rollers. The lower legs of the U-shaped cabinet rails rollingly support the pull-out rail rollers. When the drawer is in a pulled-out position, the pull-out rail rollers engage the upper legs of the U-shaped cabinet rails, so that the upper legs prevents the drawer from cantilevering forward. The bottom leg of the Z-shaped pull-out rail typically extends below the bottom edge of the front end of the cabinet rail. Therefore, in use, it is necessary to space the cabinet rail a pre-determined distance above the bottom member of the drawer opening to enable the pull-out rail and supported drawer to clear the lower member of the drawer opening. Different ways to accomplish this include, for example, use of a specially designed jig for pre-drilling mounting screw holes, use of a separate spacer, making the entire front end of the cabinet rail wider, providing a downwardly bent projection member on the cabinet rail as a spacer, and/or providing an extension member on the cabinet rail as a spacer. However, all of these approaches are costly and time consuming.

Figure 1:
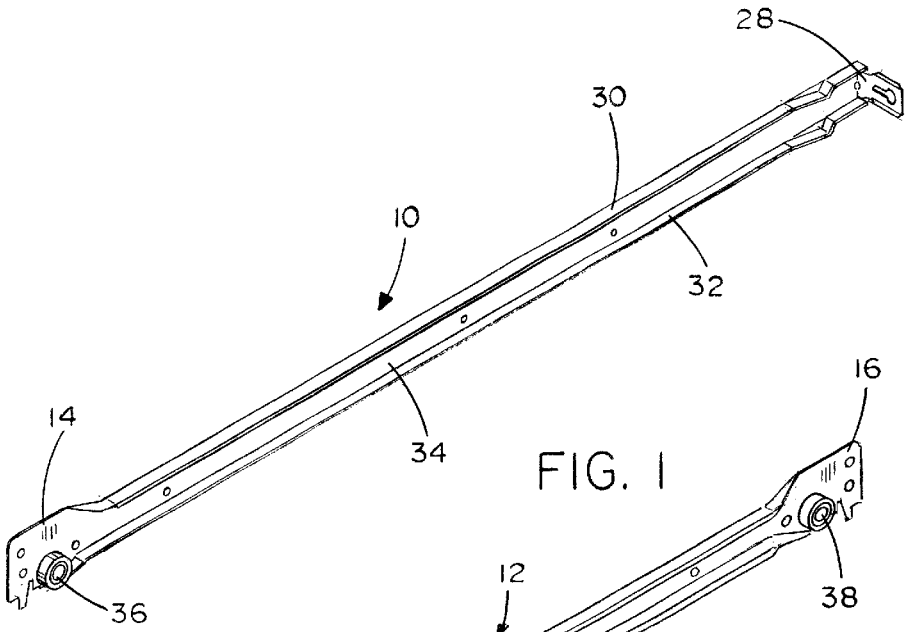
FIG. 1 shows a perspective view of an example of a left hand side self-positioning drawer guide cabinet rail for an embodiment of the present invention.
Figure 2:
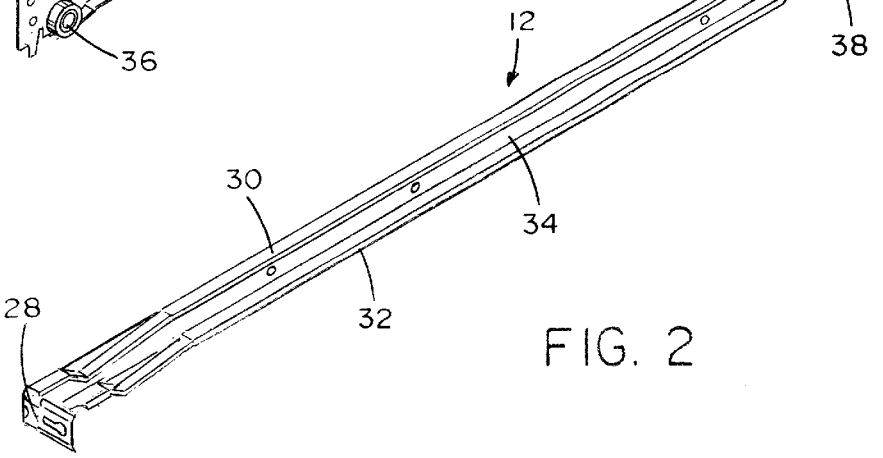
FIG. 2 shows a perspective view of an example of a right-hand side self-positioning drawer guide cabinet rail for an embodiment of the present invention.
Figure 5:
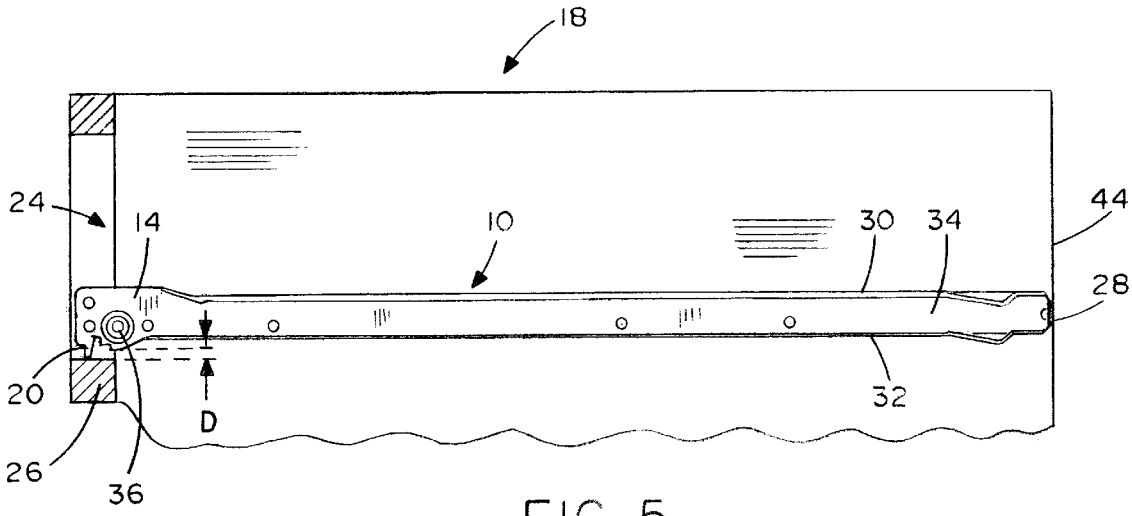
FIG. 5 is a side view of the left-hand side self positioning cabinet rail of FIG. 1 mounted in a cabinet with the projection aligned with the drawer opening to properly space the cabinet rail above the bottom of the drawer opening.
Figure 6:
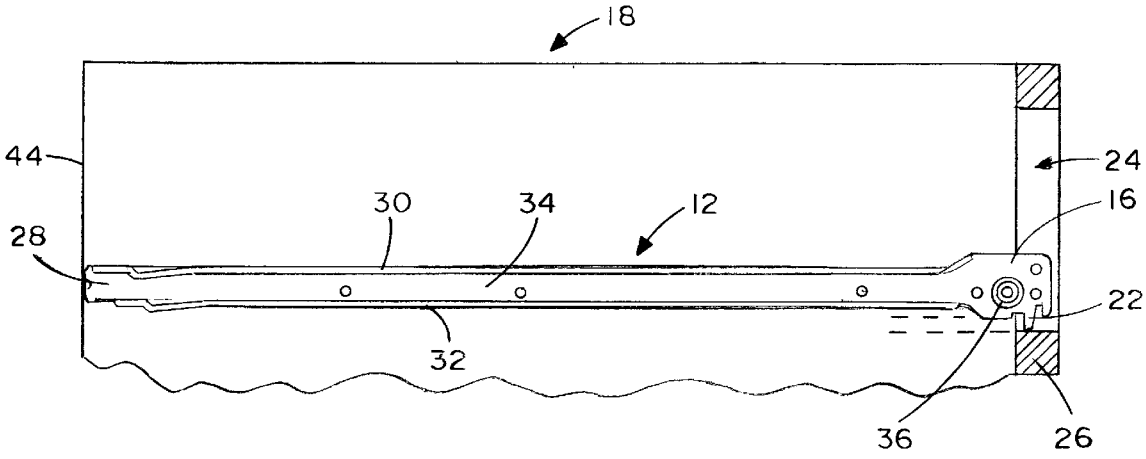
FIG. 6 is a side view of the right-hand side self positioning cabinet rail of FIG. 2 mounted in a cabinet with the projection aligned with the drawer opening to properly space the cabinet rail above the bottom of the drawer opening.
Figure 4:
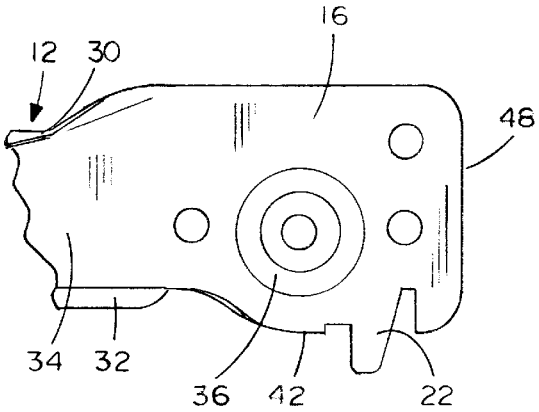
FIG. 4 is an enlarged side view of the front end of the of the right-hand side self-positioning drawer guide cabinet rail of FIG. 2.
Figure 3:
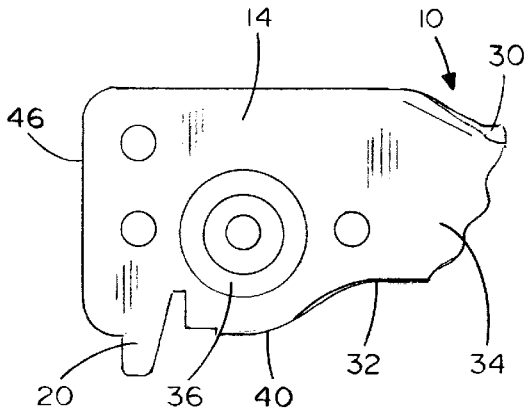
FIG. 3 is an enlarged side view of the front end of the of the left-hand side self-positioning drawer guide cabinet rail of FIG. 1.

FIGS. 1 and 2 show perspective views of examples of left-hand and right-hand side self-positioning drawer guide cabinet rails 10 and 12, respectively, for an embodiment of the present invention. FIGS. 3 and 4 show enlarged side views of the front ends 14 and 16, respectively, of the left-hand and right-hand side self-positioning drawer guide cabinet rails 10 and 12 of FIGS. 1 and 2. FIGS. 5 and 6 show side views of the left-hand and right hand side self positioning cabinet rails 10 and 12, respectively, of FIGS. 1 and 2 mounted in a cabinet 13 with a projection 20 and 22, respectively, aligned with the drawer opening 24 to properly space the cabinet rails 10 and 12 above the bottom member 26 of the drawer opening 24. The self-positioning cabinet rail 10 or 12 for an embodiment of the present invention addresses the problem of correctly positioning the cabinet rail, utilizing the projection 20 or 22, respectively, which when resting on the lower member 26 of the drawer opening 24, correctly spaces the cabinet rail 10 or 12 a pre-determined distance above the lower member 26.

Referring to FIGS. 1 through 6, an embodiment of the present invention provides a self-positioning cabinet rail 10 or 12 for a drawer guide of the type utilizing a U-shaped cabinet rail and a Z-shaped pull-out rail. The cabinet rail 10 or 12 has a front end 14 or 16, respectively, and a rear end 28. An upper ledge 30 and a lower ledge 32 extends along substantially the entire length of each cabinet rail 10 or 12, and together with a web portion 34, forms a substantially U-shaped cross section. Each cabinet rail 10 or 12 also includes a cabinet rail roller 36 or 38, respectively, rotatably mounted near its front end 14 or 16. Referring further to FIGS. 1 through 6, the front end 14 or 16 of each cabinet rail 10 or 12 has a bottom edge 40, 42, respectively, which is slightly lower than the lower ledge 32 of each cabinet rail 10, 12. Each self-positioning cabinet rail 10 or 12, for an embodiment of the present invention, also includes the projection 22 or 22 on its front end 14 or 16 that extends below the bottom edge 40 or 42 of the front end 14 or 16.

Figure 7:
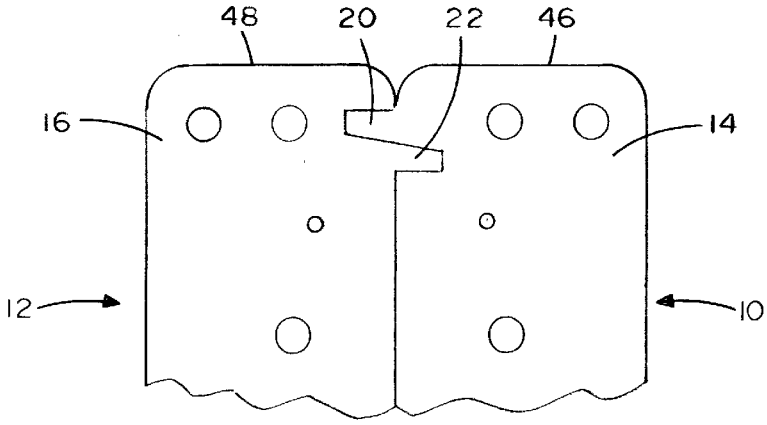
FIG. 7 is an enlarged plan view showing an example of the generally S-shaped cut near the front end of a pair of elongate blanks stamped out in pairs including a left-hand and right-hand self-positioning cabinet rail of FIGS. 1 and 2.

The cabinet rails 10 and 12 are made by first stamping out an elongate, substantially rectangular shaped blank from a web of sheet metal. Thereafter, the cabinet rails 10 and 12 are shaped by bending the long edges of the blank to form the upper leg 30 and lower leg 32 separated by the web portion 34 of the U-shaped cross section. In an embodiment of the present invention, in order to conserve steel, the elongate blanks are stamped out in pairs for the left-hand cabinet rail 10 and right hand cabinet rail 12, with a generally S-shaped cut defining the projections 20 and 22, respectively, as shown in FIG. 7. Thus, the projection 20 on the front end 14 of the left-hand cabinet rail 10 is formed from a corresponding notch on the front end 16 of the right-hand cabinet rail 12. Conversely, the projection 22 on the front end 16 of the right-hand cabinet rail 12 is formed from a corresponding notch on the front end 14 of the left-hand cabinet rail 10.

In an embodiment of the present invention, since the projection 20 on the left-hand cabinet rail 10 is formed from a notch on the right-hand cabinet rail 12 and the projection 22 on the right-hand cabinet rail 12 is formed from a corresponding notch on the left-hand cabinet rail 12, the positions of the projections 20 and 22 on cabinet rails 10, 12, respectively, are somewhat mutually exclusive, with one of the projections 20 or 22 being spaced further than the other from a front edge 46 or 48 of cabinet rails 10, 12, respectively. The size of the projections 20 or 22 is determined at least in part by the size of the corresponding Z-shaped pull-out rail and the required distance to enable the lower leg of the Z-shaped rail to clear the lower member 26 of the drawer opening 24. Further, it will be appreciated that the shape of the projections 10 or 12 may take any suitable form that is consistent with the particular stamping method of manufacture.

Each cabinet rail 10 or 12 can be made in one of a number of pre-determined standard lengths to fit within a cabinet of a corresponding one of a number of pre-determined cabinet industry standard cabinet depths (front-to-back). As shown in FIGS. 5 and 6, in use, the rear end 28 of each cabinet rail 10 or 12 is supported by fasteners, for example, on a back wall 44 of the cabinet 18. The pre-determined standard length of the cabinet rails 10 and 12 assures that the front ends 14, 16, respectively, extend a proper distance forward from the back wall 44 of the cabinet 18 of the corresponding standard depth. In this condition, the projections 20 and 22 of the cabinet rails 10 and 12 resting on the lower member 26 of the drawer opening 24 serve to space the lower edges 40 and 42 of the front ends 14 and 16 of the cabinet rails 10 and 12 the predetermined distance "D" above the lower member 26 of the cabinet 18.

Figures 8, 9:
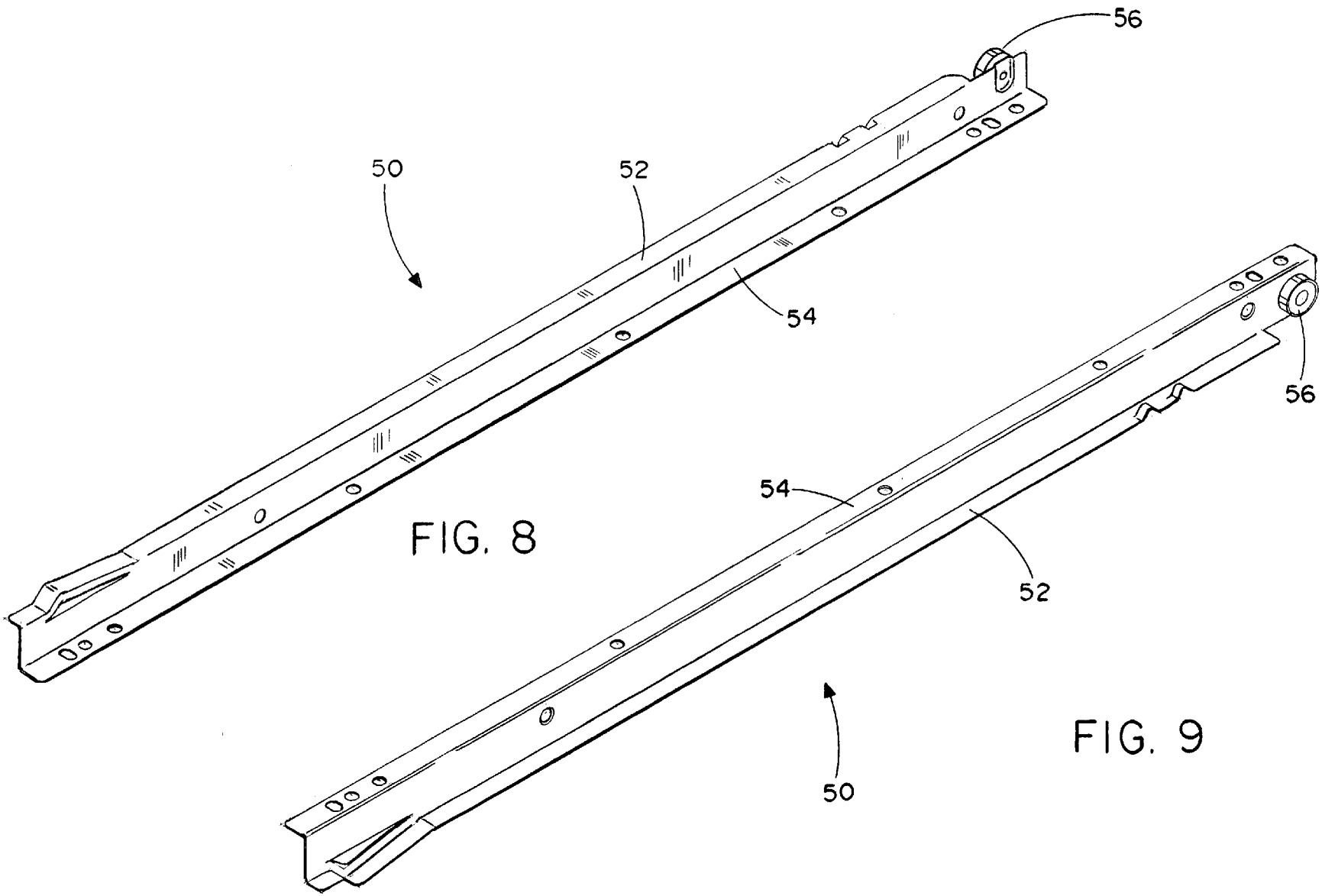
FIG. 8 shows a top right side perspective view of an example of a drawer pull-out rail having a generally Z-shaped cross section.
FIG. 9 shows an inverted left side perspective view of an example of a drawer pull-out rail having a generally Z-shaped cross section.

As shown in FIGS. 8 and 9, the pull out rail 50 has a generally Z-shaped cross section. FIG. 8 shows a top perspective view of the pull-out rail, comprising an upper ledge 52 and lower ledge 54 which are substantially parallel to one another and extend in opposite directions from substantially right angles from the vertical section of the pull-out rail. At one end is a roller 56 rotably mounted to one side of the rail. This configuration provides a generally Z-shaped cross section, and is commonly seen in drawer pull-out rails. FIG. 9 is a view of the same pull-out rail inverted 180° to show the bottom side.

Various preferred embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the present invention.

What is claimed is:

1. A cabinet rail assembly for supporting a drawer in a drawer opening of a furniture article, comprising:

a pair of cabinet rails adapted to be mounted within opposite sides of the drawer opening, each cabinet rail having a generally U-shaped cross section with a web portion disposed between upper and lower ledges, a front end portion with front and bottom edges, and a rotatable cabinet rail roller mounted on the front end portion; and each cabinet rail having a projection on the bottom edge of the front end portion extending a predetermined distance below the bottom edge and adapted to space the bottom edge of the cabinet rail by the pre-determined distance above a bottom member of the drawer opening, the projection on one of the cabinet rails being spaced a further distance from the front edge of the cabinet rail than the projection on the other of the cabinet rails.

2. The cabinet rail assembly of claim 1, wherein the projection on the front end portion of each of the cabinet rails corresponds to a notch in the front end portion of the other of the cabinet rails.

3. The cabinet rail assembly of claim 1, wherein the projection on the front end portion of each of the cabinet rails is positioned adjacent a notch in the front end portion of the cabinet rail.

4. The cabinet rail assembly of claim 1, wherein the projection on the front end portion of each of the cabinet rails is positioned adjacent a notch, which together with the projection, defines a generally S-shaped perimeter of the projection and adjacent notch.

5. The cabinet rail assembly of claim 1, wherein the pair of cabinet rails further comprise a left-hand side cabinet rail and a right-hand side cabinet rail, each adapted to receive a corresponding drawer pull-out rail having a generally Z-shaped cross section.

6. A cabinet rail assembly for supporting a drawer in a drawer opening of a furniture article, comprising:

a pair of cabinet rails adapted to be mounted within opposite sides of the drawer opening, each cabinet rail having a generally U-shaped cross section with a web portion disposed between upper and lower ledges, a front end portion with front and bottom edges, and a rotatable cabinet rail roller mounted on the front end portion; and each cabinet rail having a projection on the bottom edge of the front end portion extending a predetermined distance below the bottom edge and adapted to space the bottom edge of the cabinet rail by the pre-determined distance above a bottom member of the drawer opening, the projection on the front end portion of each of the cabinet rails being positioned adjacent a notch in the front end portion of the cabinet rail, the projection on the front end portion of each of the cabinet rails corresponding to the notch in the front end portion of the other of the cabinet rails.

7. The cabinet rail assembly of claim 6, wherein the pair of cabinet rails further comprise a left-hand side cabinet rail and a right-hand side cabinet rail, each adapted to receive a corresponding drawer pull-out rail having a generally Z-shaped cross section.

8. A cabinet rail assembly for supporting a drawer in a drawer opening of a furniture article, comprising:

a pair of cabinet rails adapted to be mounted within opposite sides of the drawer opening, each cabinet rail having a generally U-shaped cross section with a web portion disposed between upper and lower ledges, a front end portion with front and bottom edges, and a rotatable cabinet rail roller mounted on the front end portion; and each cabinet rail having a projection on the bottom edge of the front end portion extending a predetermined distance below the bottom edge and adapted to space the bottom edge of the cabinet rail by the pre-determined distance above a bottom member of the drawer opening, the projection on the front end portion of each of the cabinet rails being positioned adjacent a notch, which together with the projection, defines a generally S-shaped perimeter of the projection and adjacent notch, the projection on the front end portion of each of the cabinet rails corresponding to the notch in the front end portion of the other of the cabinet rails.

9. The cabinet rail assembly of claim 8, wherein the pair of cabinet rails further comprise a left-hand side cabinet rail and a right-hand side cabinet rail, each adapted to receive a corresponding drawer pull-out rail having a generally Z-shaped cross section.

* * * * *

UNITED STATES PATENT AND TRADEMARK OFFICE

CERTIFICATE OF CORRECTION

PATENT NO. : 6,619,771 B2 
DATED : September 16, 2003
INVENTOR(S) : Wernfried Kueng, Joseph B. Larsen, Jr. and Kerry L. Kerr It is certified that error appears in the above-identified patent and that said Letters Patent is hereby corrected as shown below:

Column 4,
Line 25, that portion reading "2 mounted in a cabinet 13 with a projection 20 and 22," should read -- 2 mounted in a cabinet 18 with a projection 20 and 22, --.

Signed and Sealed this

Twenty-second Day of June, 2004

JON W. DUDAS
*Acting Director of the United States Patent and Trademark Office*